US012005371B2

(12) United States Patent
Ito

(10) Patent No.: US 12,005,371 B2
(45) Date of Patent: Jun. 11, 2024

(54) BLOCK-TYPE TRANSFORMABLE TOY

(71) Applicant: Yoshiaki Ito, New York City, NY (US)

(72) Inventor: Yoshiaki Ito, New York City, NY (US)

( * ) Notice: Subject to any disclaimer, the term of this patent is extended or adjusted under 35 U.S.C. 154(b) by 0 days.

(21) Appl. No.: 17/628,116

(22) PCT Filed: Nov. 11, 2020

(86) PCT No.: PCT/JP2020/042068
§ 371 (c)(1),
(2) Date: Jan. 18, 2022

(87) PCT Pub. No.: WO2021/095765
PCT Pub. Date: May 20, 2021

(65) Prior Publication Data

US 2022/0274031 A1 Sep. 1, 2022

Related U.S. Application Data

(60) Provisional application No. 62/934,342, filed on Nov. 12, 2019.

(51) Int. Cl.
*A63H 3/46* (2006.01)
*A63H 33/00* (2006.01)

(52) U.S. Cl.
CPC ..... *A63H 3/46* (2013.01); *A63H 33/003* (2013.01)

(58) Field of Classification Search
CPC ..... A63H 3/46; A63H 33/003; A63H 3/04; A63H 33/04
USPC ..... 446/354, 368, 376, 379, 380, 119
See application file for complete search history.

(56) References Cited

U.S. PATENT DOCUMENTS 957,666 A 5/1910 Washington
3,577,673 A * 5/1971 Monestier ..... A63H 33/103 446/490
D306,621 S * 3/1990 Doi ..... D21/513
4,997,375 A * 3/1991 Heinz ..... F16M 11/40 446/119

(Continued)

FOREIGN PATENT DOCUMENTS

CN 204395434 U 6/2015
CN 209677578 U 11/2019

(Continued)

OTHER PUBLICATIONS

International Search Report for International Application No. PCT/JP2020/042068.

*Primary Examiner* — Nini F Legesse
(74) *Attorney, Agent, or Firm* — Taro Yaguchi

(57) ABSTRACT

Adjacent blocks are biased in directions of mutual contact using elastic cords, the adjacent blocks being changed so that surfaces having mutually different positional relationships are brought into contact with each other in resistance to the biasing force of the elastic cords, whereby the blocks can be transformed between a state of being folded so that the external shape becomes compact, and a state of being extended so as to take on the shape of an object to be expressed. Furthermore, at least two of the blocks among the plurality of blocks have a state in which two surfaces of each of the blocks simultaneously contact each other, the block-type transformable toy thereby being configured so that turning about the elastic cords is limited.

7 Claims, 12 Drawing Sheets

(56) References Cited

U.S. PATENT DOCUMENTS

| | | | | |
|---|---|---|---|---|
| 5,302,148 | A * | 4/1994 | Heinz | A63F 9/088 446/490 |
| 6,482,063 | B1 * | 11/2002 | Frigard | A63H 33/103 446/124 |
| 9,993,739 | B2 * | 6/2018 | Weeks | A63H 3/04 |
| 2010/0221975 | A1 | 9/2010 | Kimbrough | |
| 2012/0156960 | A1 * | 6/2012 | Weeks | A63H 3/46 446/376 |
| 2016/0136531 | A1 | 5/2016 | Manichon | |
| 2016/0206965 | A1 | 6/2016 | Cummings | |
| 2017/0106302 | A1 | 4/2017 | Cummings et al. | |
| 2018/0078870 | A1 * | 3/2018 | Yu | A63H 17/02 |
| 2018/0184768 | A1 | 7/2018 | Kimbrough et al. | |

FOREIGN PATENT DOCUMENTS

| | | | |
|---|---|---|---|
| JP | 1986-042995 | U | 3/1986 |
| JP | 1990-028297 | U | 2/1990 |
| JP | 3015685 | U | 9/1995 |
| JP | 1997-155068 | A | 6/1997 |
| WO | 2016-114821 | A1 | 7/2016 |
| WO | 2018-129361 | A1 | 7/2018 |

* cited by examiner

BLOCK-TYPE TRANSFORMABLE TOY

FIELD OF THE INVENTION

This invention relates to a transformable toy formed by connecting blocks to each other with rubber cord.

BACKGROUND ART

The humanoid-robot block-type transformable toys disclosed in Patent Documents 1 and 2 below are conventional.

These toys are basically such that the transformable toy is constituted by assembling regular hexahedron shaped blocks by way of the biasing force of rubber cords. That is to say, these transformable toys can be transformed into a state in which the outer shape is folded so as to have a box shape and a state in which the outer shape is extended so as to have a humanoid robot shape.

PRIOR ART REFERENCES

Patent References

Patent Reference 1: U.S. Pat. No. 6,482,063 B "Articulating Blocks Toy"

Patent Reference 2: U.S. Application Publication No. 2012-0156960 A1 "Transformable Toy Robot"

SUMMARY OF THE INVENTION

Problems to Be Solved by the Invention

Here, there are currently no transformable block toys that represent complicated shapes with good aesthetics.

This is because conventional block-type transformable toys emphasize allowing a humanoid robot to take on various postures in order to enhance play. For this reason, hexahedral blocks are often used, and the angles formed by the surfaces constituting the blocks are essentially 90 degrees. When such hexahedral blocks are used, the blocks in contact with each other can be freely rotated, and a humanoid robot can be made to take various postures. For this reason, for example, the posture of the head can be turned in a direction that is impossible in reality, and since this is allowed, no thought was given to enhancing aesthetics.

This invention has been made in view of such circumstances, and an object thereof is to provide a block-type transformable toy capable of realizing shapes with complicated aesthetics, for example, various animal shapes, while ensuring degrees of freedom in folding.

Another object is to provide a block-type transformable toy with which it is easy to realize a coherent outer shape by reliably positioning the blocks relative to each other when the block-type transformable toy composed of blocks having a complicated shapes is folded.

Means for Solving Problems

In order to solve the aforementioned problems, in keeping with the main views of this invention, the following aspects are provided.

(1) A block-type transformable toy that represents the shape of an object by way of combining a plurality of blocks, characterized in that:

adjacent blocks are urged by an elastic cord member in a direction of mutual contact;

transformation is possible between a state of being folded so that the outer shape is compact and a state of being extended so that the shape represents the object, by changing the mutual positional relationships between adjacent blocks, so that different surfaces contact each other against the urging force of the elastic cord member;

and the configuration is such that at least two blocks out of the plurality of blocks are in a state in which two surfaces of each are in contact with each other at the same time, whereby rotational movement around the elastic cord member is restricted.

(2) The block-type transformable toy according to (1) above, wherein the block-type transformable toy is an animal-shaped block-type transformable toy that represents at least a head portion, a torso portion, and a leg portion by way of combining of a plurality of blocks.

(3) The block-type transformable toy according to (1) above, wherein the state of being folded is configured so that the outer shape is a box shape.

(4) The block-type transformable toy according to (1) above, wherein angles between the two surfaces are 30 degrees to 170 degrees and 190 degrees to 330 degrees.

(5) The block-type transformable toy according to (1) above, wherein the two blocks have two or more states in which two surfaces of each are in contact with each other at the same time.

(6) The block-type transformable toy according to (5) above, wherein the two or more states are, respectively, a state of being folded and a state of being extended.

(7) The block-type animal-shaped transformable toy according to (2) above, wherein the two blocks are blocks constituting a head portion and a torso, and displacement of the head portion in a direction of rotational movement with respect to the torso is restricted by the configuration.

Note that features other than those described above are disclosed in the following description and drawings of the modes of embodiment of the invention.

MODES FOR CARRYING OUT THE INVENTION

Hereafter, one mode of embodiment of the present invention will be described with reference to the accompanying drawings.

Figure 1:
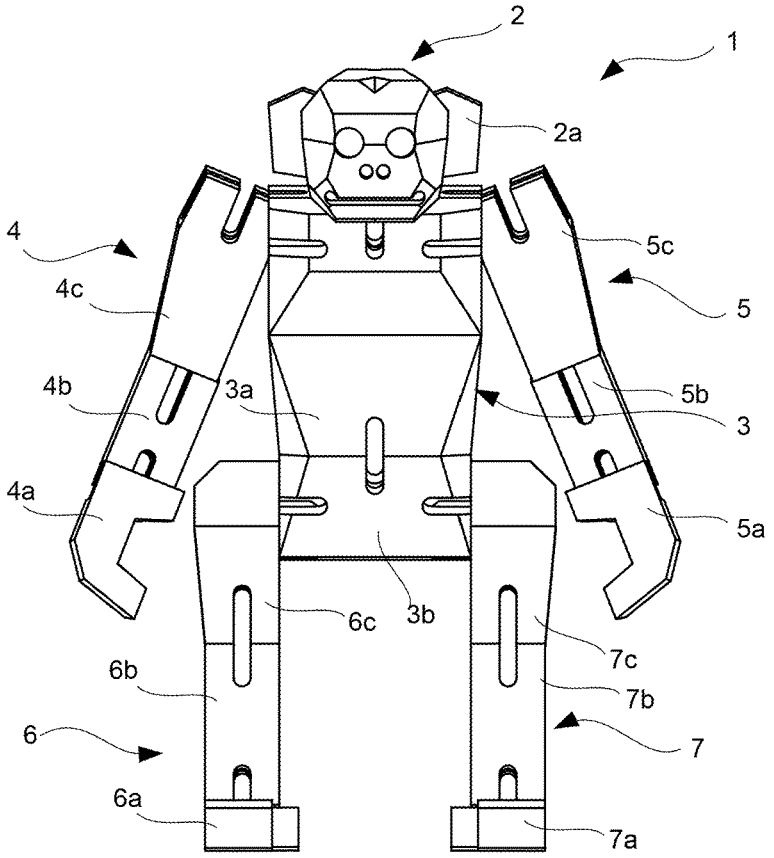
FIG. 1 is a front view of a monkey-shaped block-type transformable toy illustrating one mode of embodiment of the present invention.

FIG. 1 shows a monkey-shaped block-type transformable toy 1, which is an animal-shaped block-type transformable toy of this mode of embodiment.

(Extended State)

This monkey-shaped block-type transformable toy 1 represents a monkey by combining a plurality of blocks 2*a*, 3*a*-3*b*, 4*a*-4*c*, 5*a*-5*c*, 6*a*-6*c*, and 7*a*-7*c*, which make up a head portion 2, a torso portion 3, a right arm portion 4, a left arm portion 5, a right leg portion 6, and left leg portion 7. The block-type transformable toys of the prior art were designed as humanoid robots, but in this example of the invention, it is possible to represent a specific kind of animal by making a complicated shape, including by way of the manner in which the blocks 2*a*, 3*a*-3*b*, 4*a*-4*c*, 5*a*-5*c*, 6*a*-6*c*, and 7*a*-7*c* are combined with each other.

Figure 2:
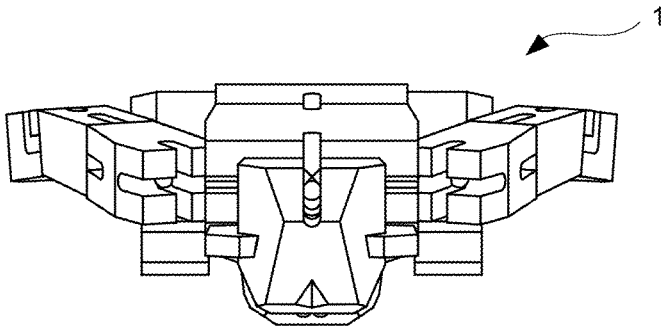
FIG. 2 is a plan view of the same.
Figure 3:
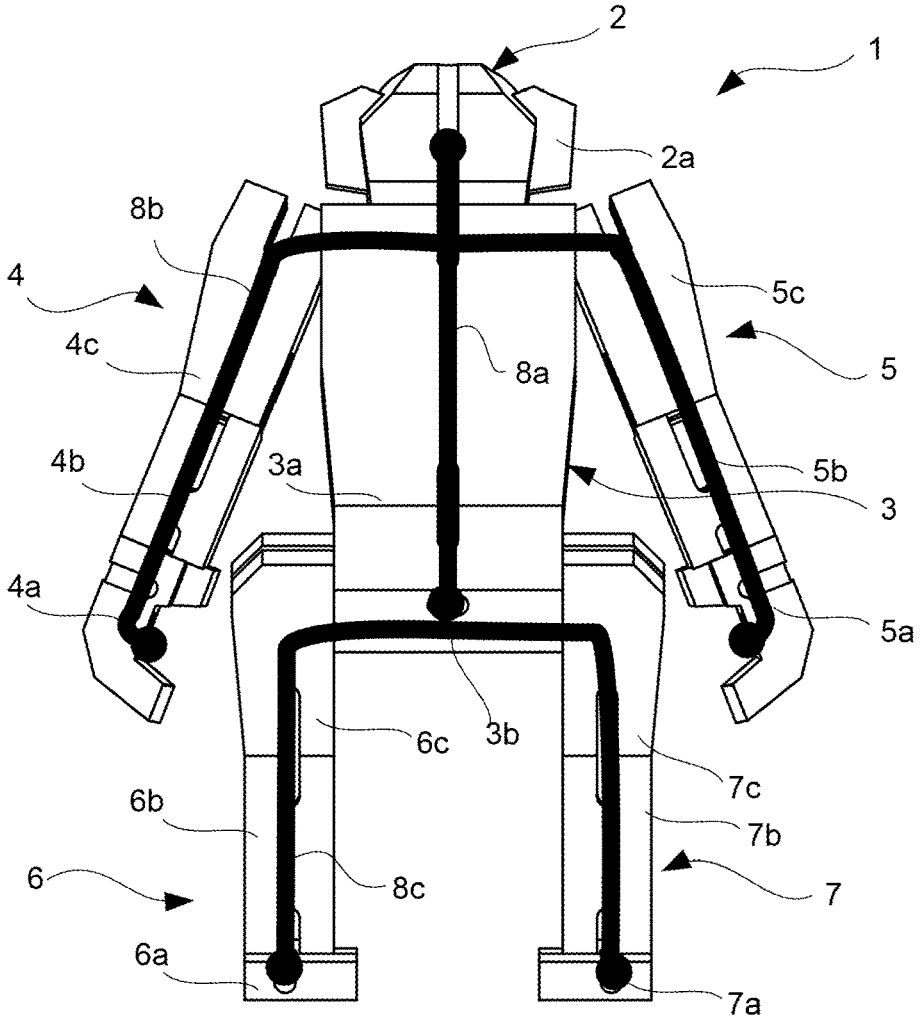
FIG. 3 is a rear view of the same (with the rubber cord visible therethrough).
Figure 4:
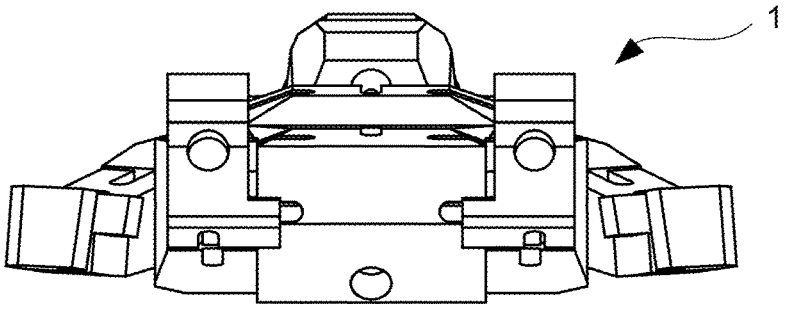
FIG. 4 is a bottom view of the same.
Figure 5:
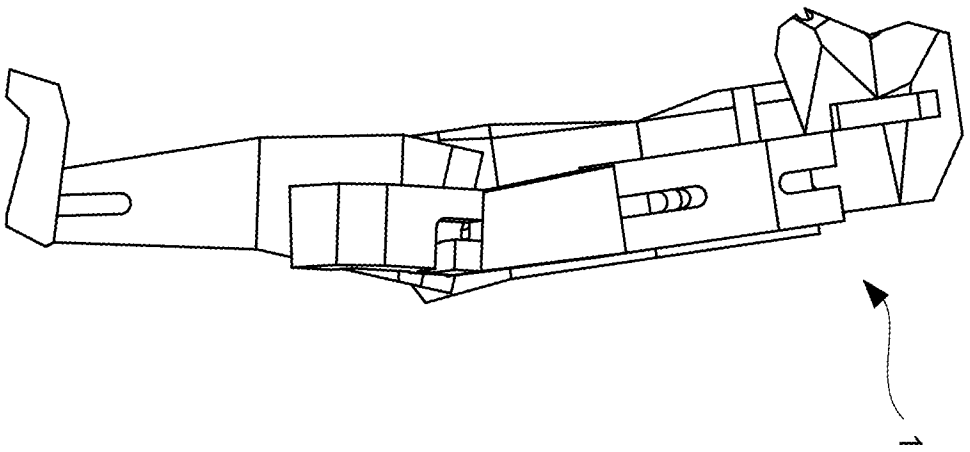
FIG. 5 is a side view of the same.
Figure 6:
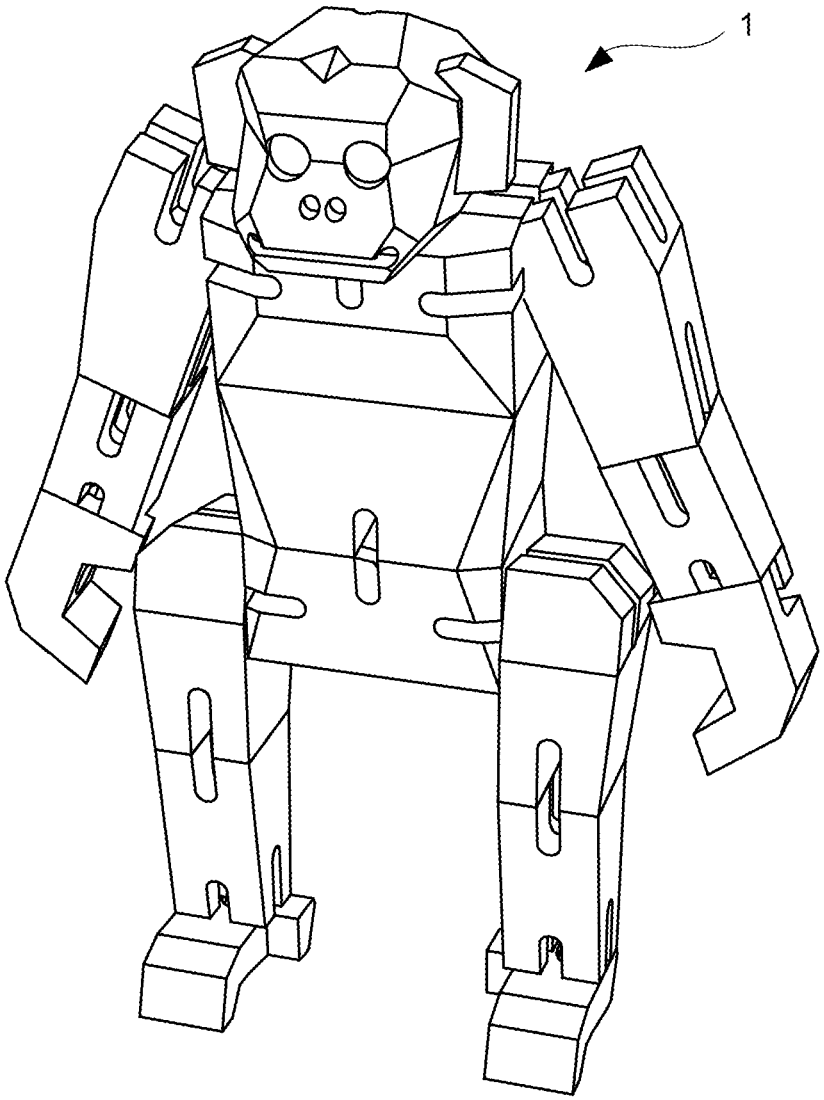
FIG. 6 is a perspective view of the same.

FIG. 2 shows a plan view of this monkey-shaped block-type transformable toy;

FIG. 3 shows a rear view; FIG. 4 shows a bottom view; and FIG. 5 shows a right side view. Furthermore, FIG. 6 shows a perspective view.

Here, as shown in the rear view in FIG. 3, each of blocks 2*a*-7*c* are urged in directions of approach to each other by first to third rubber cord members indicated by 8*a*-8*c* in the figure. That is to say, the head portion 2 and the torso 3 portion are assembled by way of extending a first rubber cord member 8*a* from the block 2*a* constituting the head portion 2 to the block 3*b* constituting the buttocks portion of the torso portion 3, through the block 3*a* constituting the torso portion 3, and engaging protuberances formed at both ends thereof in the blocks 2*a* and 3*b* at the two ends. The rubber cord members 8*a*-8*c* are actually embedded in the toy and cannot be seen from the outside but are shown visible therethrough in FIG. 3.

Furthermore, the blocks 4*a*-4*c* and 5*a*-5*c* of the arm portions 4 and 5 are assembled and attached to the torso portion 3 by extending a second rubber cord member 8*b* from the block 4*a* constituting the hand of the right arm portion to the block 5*a* constituting the left arm portion, through the blocks 4*b*, 4*c*, 3*a*, 5*c* and 5*b*; and engaging protuberances formed at both ends thereof with the blocks 4*c* and 5*c* at the two ends.

Furthermore, the blocks 6*a*-6*c* and 7*a*-7*c* of the two legs are assembled onto the block 3*b* of the torso portion 3 by extending a third rubber cord member 8*c* from the block 6*a* constituting the foot portion of the right leg portion to the block 7*a* constituting the left leg portion through the blocks 6*b*, 6*c*, 3*b*, 7*c*, 7*b*, and engaging protuberances formed at both ends thereof with the blocks 6*a* and 7*a* at the two ends.

(Folded State)

Figure 7:
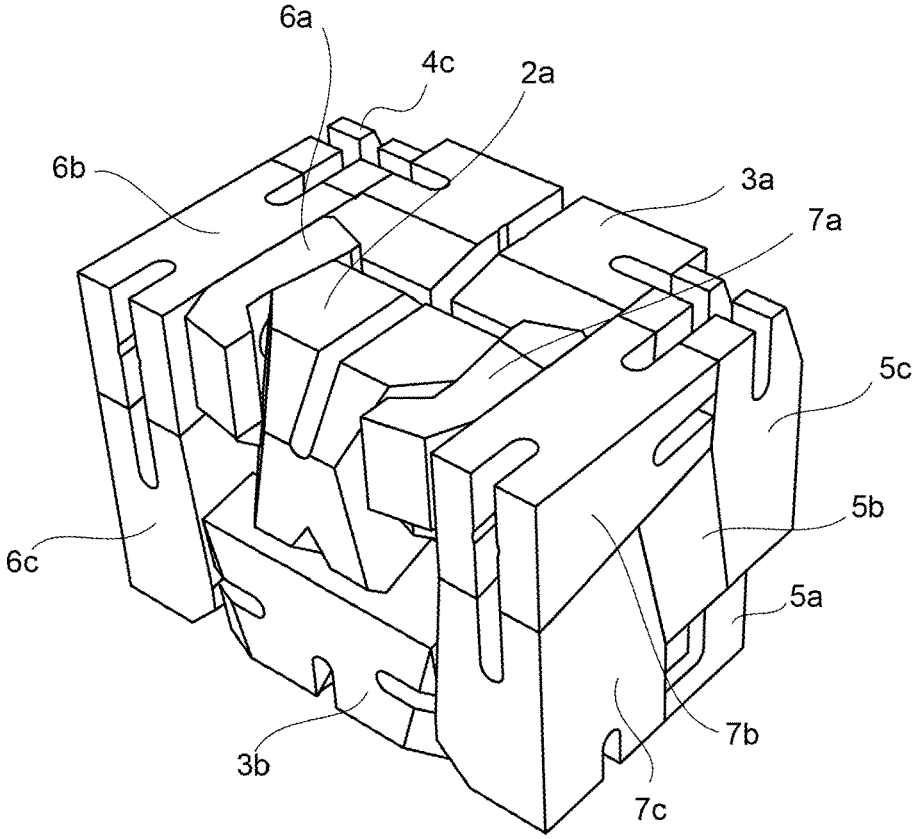
FIG. 7 is a perspective view of the same illustrating a state of being folded.

Then, by changing the mutual positional relationships between adjacent blocks, so that different surfaces contact each other, against the urging force of the rubber cord members 8*a*-8*c*, transformation is possible from the state of being extended as shown in FIG. 1-FIG. 6, to the state of being folded as shown in FIG. 7.

Figure 8:
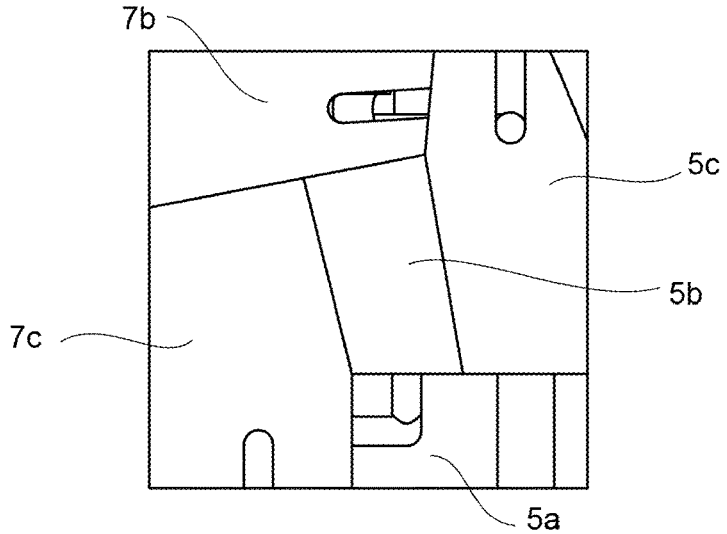
FIG. 8 is a side view of the same.
Figure 9:
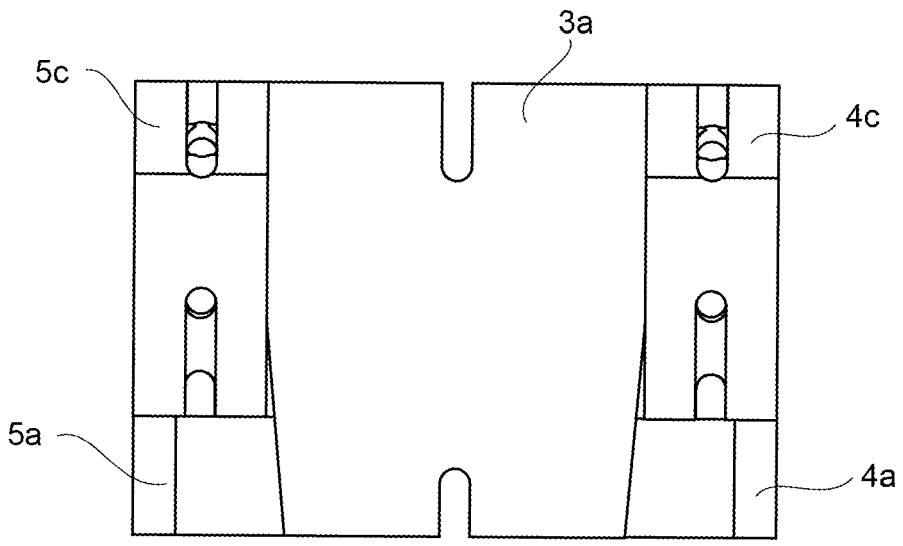
FIG. 9 is a rear view of the same.
Figure 10:
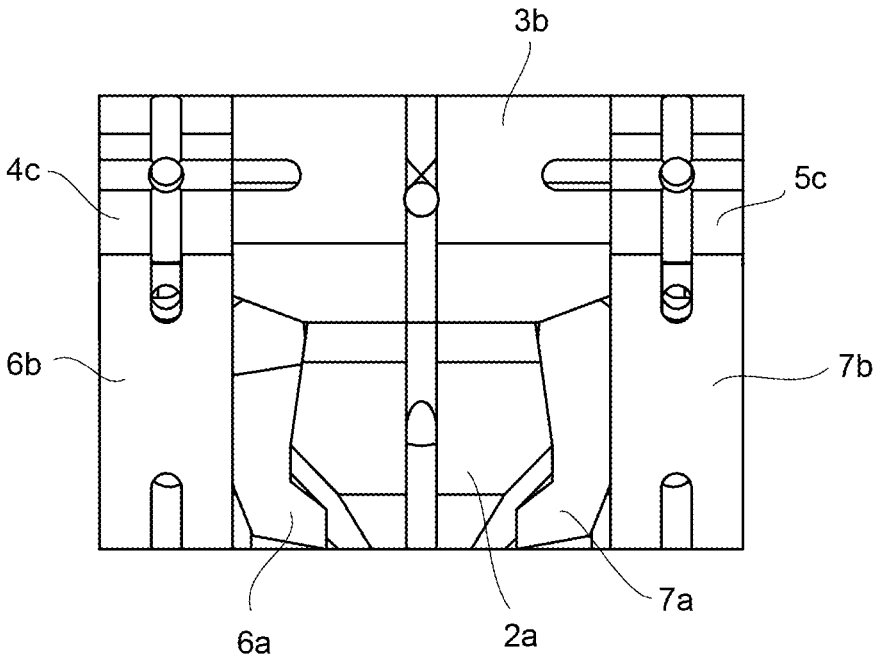
FIG. 10 is a plan view of the same.
Figure 11:
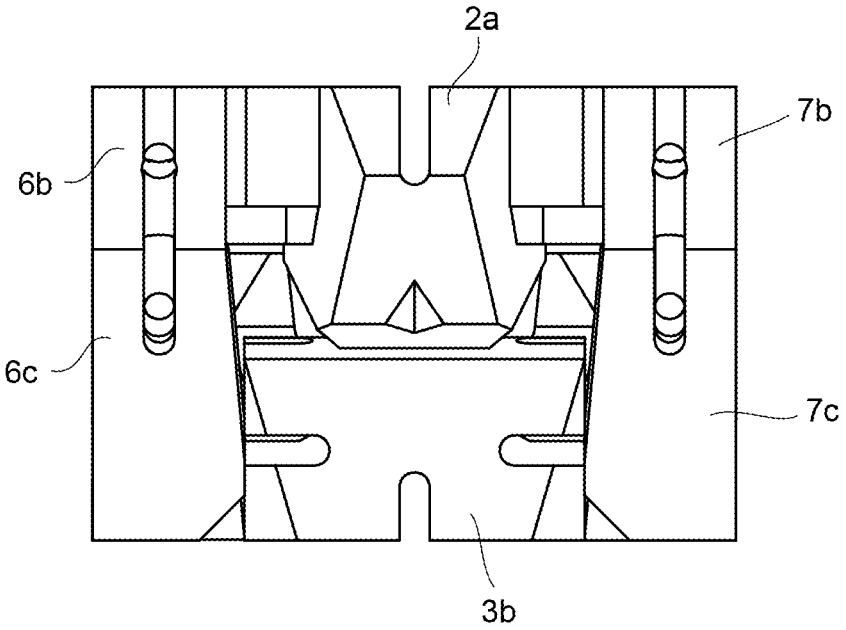
FIG. 11 is a front view of the same.
Figure 12:
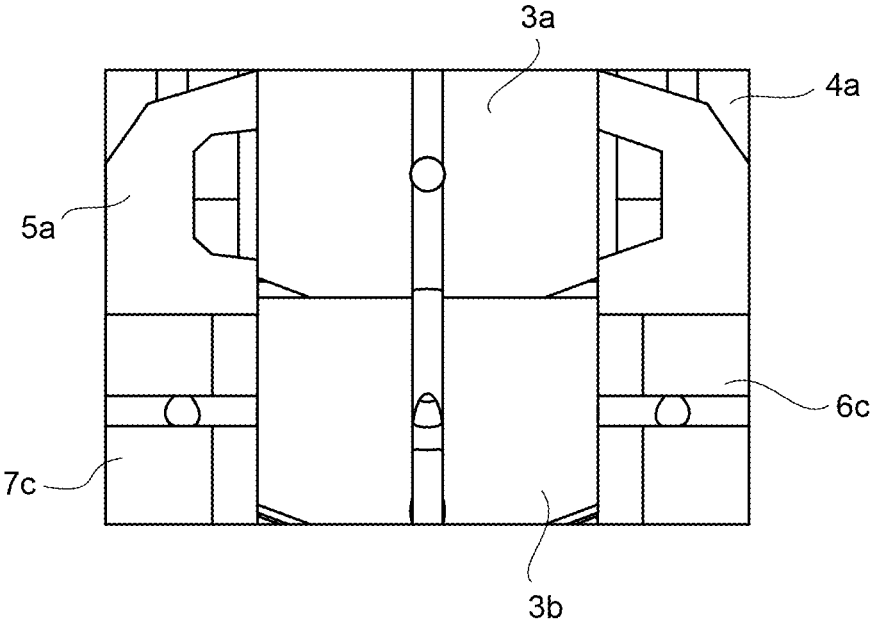
FIG. 12 is a bottom view of the same.

Here, FIG. 7 shows a perspective view illustrating the state of being folded of this monkey-shaped block-type transformable toy; FIG. 8 shows a side view; FIG. 9 shows a rear view; FIG. 10 shows a plan view; FIG. 11 shows a front view; and FIG. 12 shows a bottom view.

(Combining Blocks)

Further, as described in the claims, the configuration is such that at least two blocks out of the plurality of blocks are in a state in which two surfaces of each are in contact with each other at the same time, whereby rotational movement around the rubber cord member is restricted.

Figure 13A:
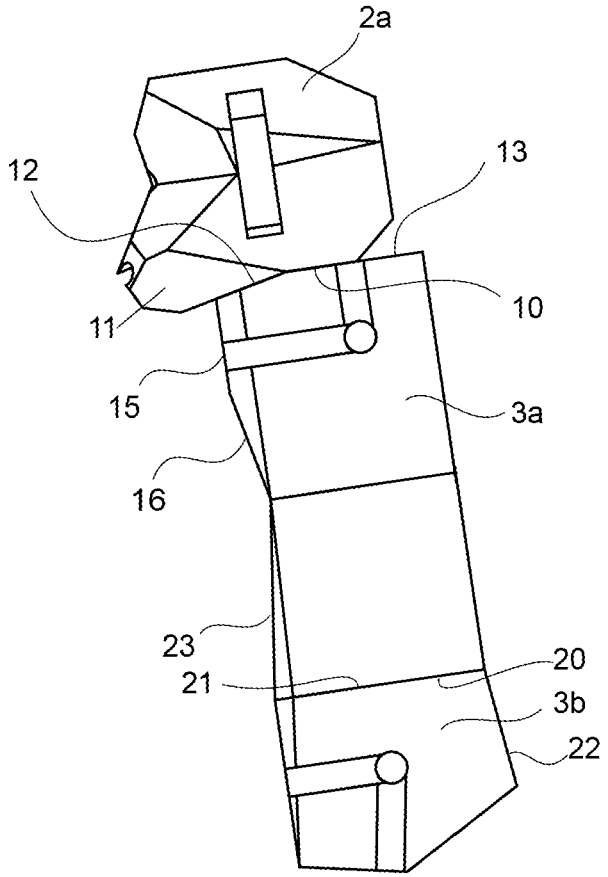
FIGS. 13A and B are schematic views of the same illustrating a head portion and torso portion.
Figure 13B:
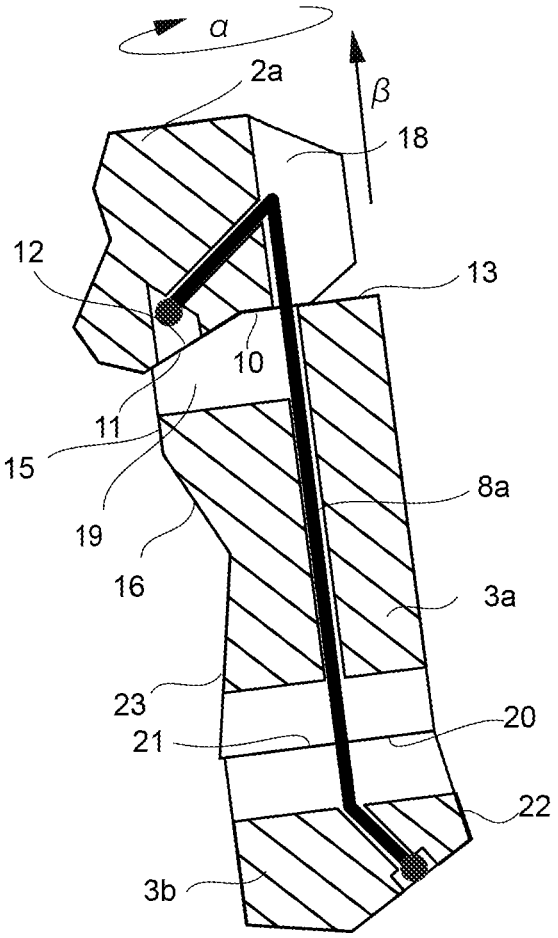
Figure 14:
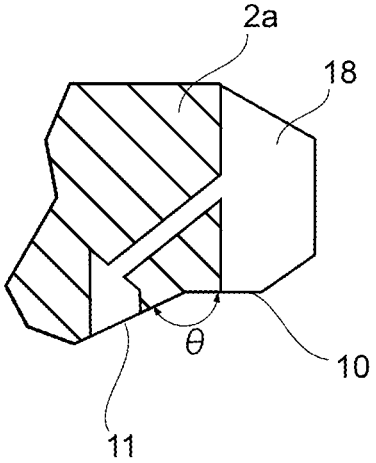
FIG. 14 is a schematic view (cross-sectional view) of the same illustrating a head portion.

Specifically, in this mode of embodiment, as shown in FIGS. 13A and 13B, the two blocks are the block 2*a* constituting the head portion 2 and the block 3*a* constituting the upper chest portion of the torso portion 3, and, as a result of this configuration, displacement of the head portion 2 with respect to the torso 3 in the direction of rotational movement thereof is restricted. That is to say, in this mode of embodiment, the lower surfaces 10 and 11 (two surfaces referred to in the claims) of the block 2*a* constituting the head portion 2 are inclined to form an angle θ of 160 degrees (see FIG. 14), and the upper surfaces 12 and 13 of block 3*a* constituting the torso portion 3 that simultaneously abut the two surfaces of the head portion form an angle of 200 degrees (value resulting from subtracting the angle of 160 degrees formed by the two lower surfaces 10 and 11 of the head portion 2 from 360 degrees).

Furthermore, since the two blocks 2*a* and 3*a* are urged in the direction of abutment against each other by the rubber cord member 8*a*, if rotational movement around the extension of the elastic cord member 8*a* (in the direction shown by arrow α) is attempted starting from the state in which the two surfaces are in contact with each other, the two surfaces 10/11 and 12/13 will obstruct each other such that the two blocks 2*a* and 3*a* will be driven against the urging force of the elastic cord member 8*a* in the direction of separation from each other (in the direction shown by arrow β). The configuration is thereby such that the rotational movement in the direction indicated by the arrow α is restricted, and when the hand is released, the position will return to the original position, that is, the position in which the two surfaces 10/11 and 12/13 abut.

Figure 15:
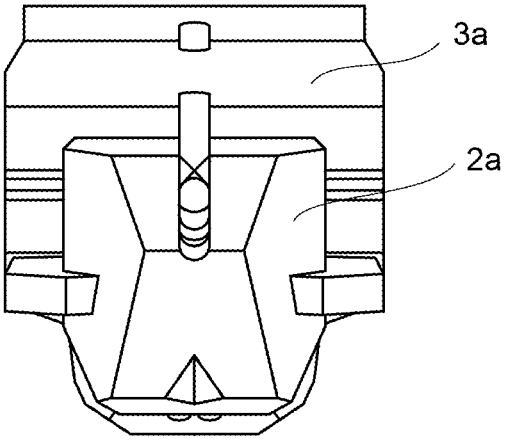
FIG. 15 is a plan view of FIG. 13A.
Figure 16:
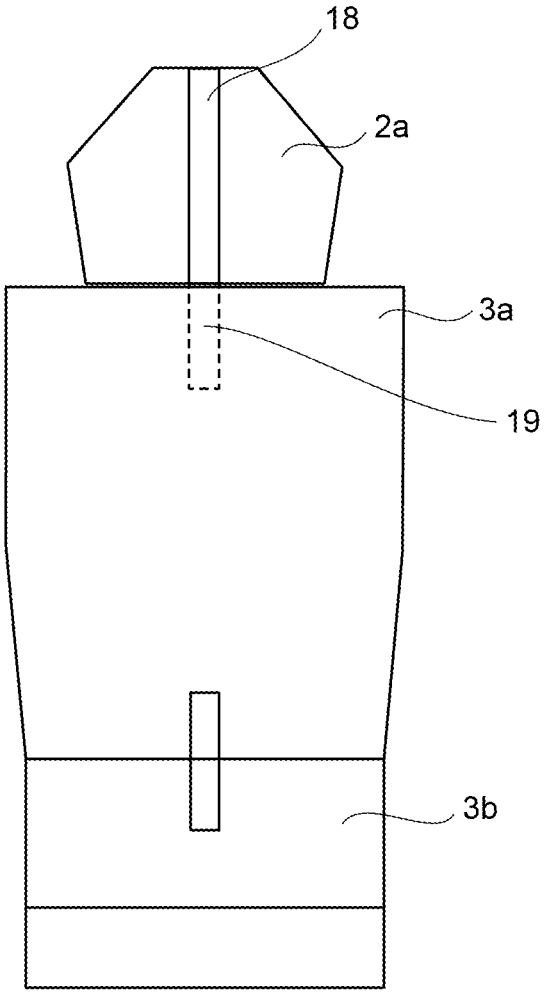
FIG. 16 is a rear view of FIG. 13A.

Note that FIG. 15 is a plan view of FIG. 13A, and FIG. 16 is a rear view.

Furthermore, FIG. 17A to FIG. 21 are views showing a state in which the three blocks 2*a*, 3*a*, and 3*b* shown in FIG. 13A are folded.

Figure 17A:
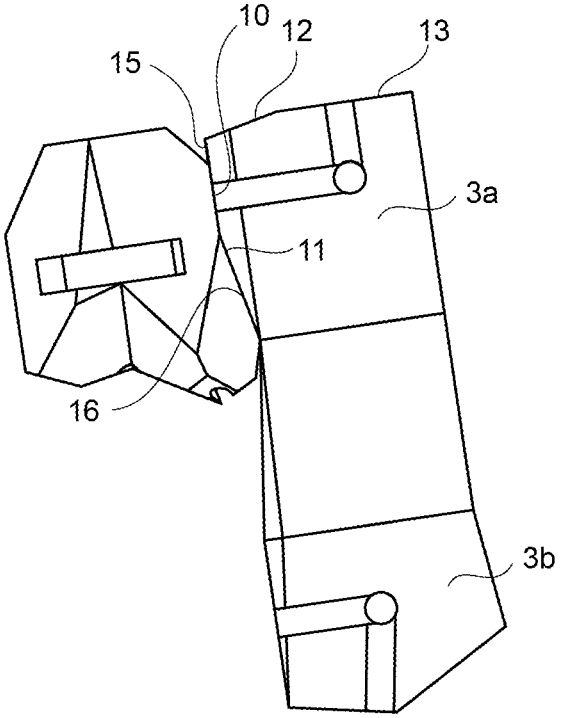
FIGS. 17A and B are schematic views illustrating a state in which the head portion in FIGS. 13A and B is folded.

When folding in this way, first, the head portion 2 is folded as shown in FIG. 17A.

In this state as well, two surfaces 15/16, which mesh with the two surfaces 10/11 formed on the head portion 2, are formed on the front surface of the block corresponding to the upper chest of the torso portion 3, such that a state is produced in which these are in contact with each other. That is to say, the upper chest of the torso portion is formed with two adjacent surfaces 15, 16 forming an angle of 200 degrees, so that the two surfaces 10/11 and 15/16 come into contact with each other.

Figure 17B:
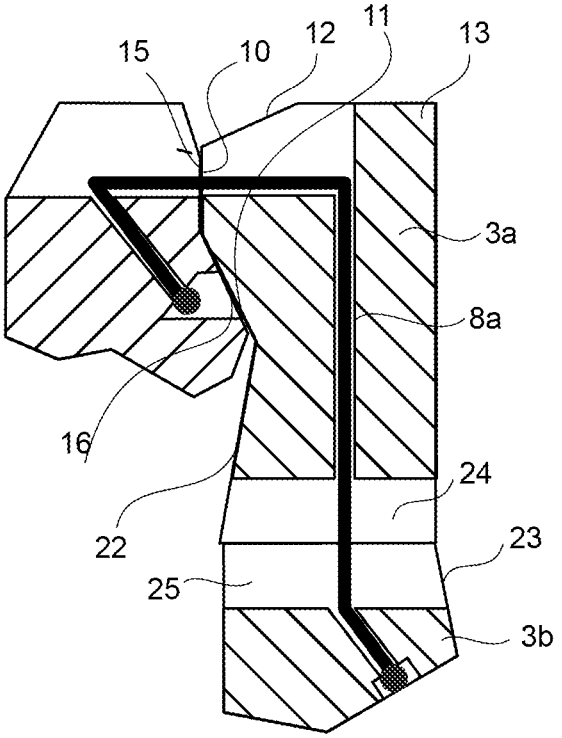
Figure 18A:
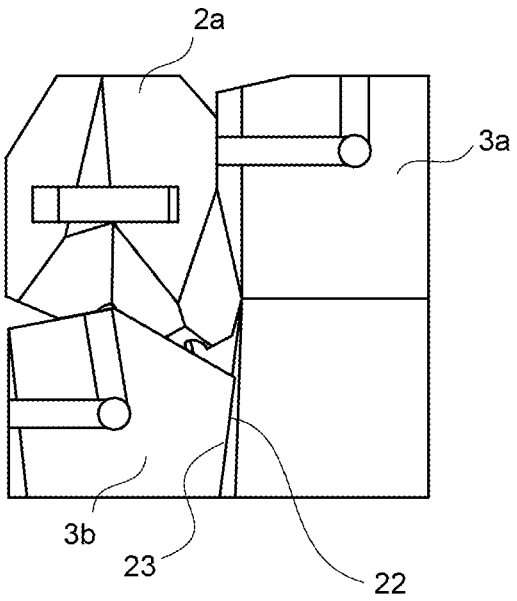
FIGS. 18A and B are schematic views illustrating a state in which the head portion and the torso portion in FIGS. 13A and B are folded.
Figure 18B:
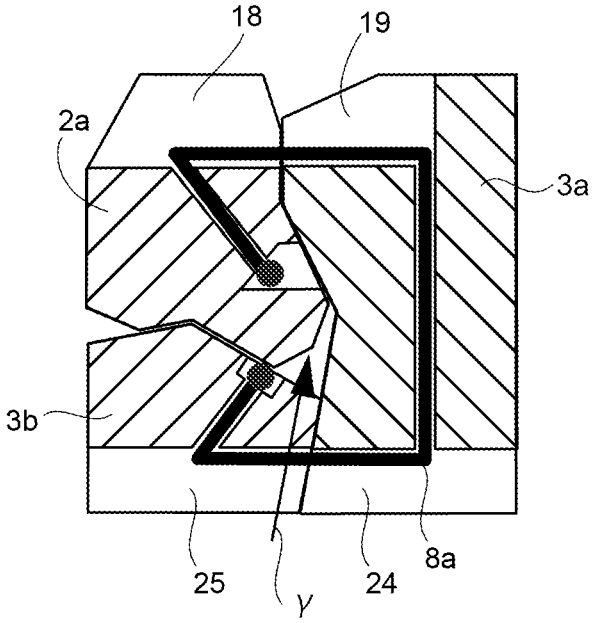

As shown in FIG. 13B and FIG. 16, the head portion 2 is formed with a slit 18 in the vertical direction in the back of the head portion. Furthermore, the torso portion 3 is formed with slits 19 that open in the directions of the upper surfaces 12/13 and the front surfaces 15/16. As a result, the rubber cord member 8*a* is routed without being obstructed by the blocks 2*a* and 3*a*, and the head portion 2 can be folded as shown in FIG. 17B.

Furthermore, as shown in FIGS. 13A and B, in the torso portion 3, the block 3*b* constituting the lower abdomen of the body is attached to the lower part of the block 3*a* to which the head portion 2 is attached. The other end of the rubber cord member 8*a* is fixed to this block 3*b*.

These two blocks 3*a* and 3*b* are in contact with each other at one surface 20/21, and in the state shown in FIGS. 13A and 13B, can freely move in rotation (arrow α) around the rubber cord member 8*a*. In this respect, the angle of rotational movement is not restricted because these are not in contact with each other at two surfaces, as in the case of the head portion 2.

On the other hand, the rear portion (buttocks) of the block 3*b*, which constitutes the lower abdomen, is provided with an inclined surface 22, which is inclined at approximately 15 degrees with respect to the direction of the rubber cord member 8*a*, and an inclined surface 23 is provided at the same angle in a corresponding portion in the abdomen portion of the block 3*a*, which constitutes the torso. Furthermore, when folding, the two surfaces 22 and 23 are brought into contact with each other so that the block 3*b* is urged upward (in the direction of arrow γ) along the inclination and caused to abut the head portion 2 (2*a*), allowing the lower surfaces (shown in FIGS. 18A and 18B) to be flush when folded.

Note that the blocks 3*a* and 3*b* are provided with slits 24 and 25 spanning the surfaces 20, 21 and 22, 23, such that the rubber cord member 8*a* is not obstructed by the block when folded.

Figure 19:
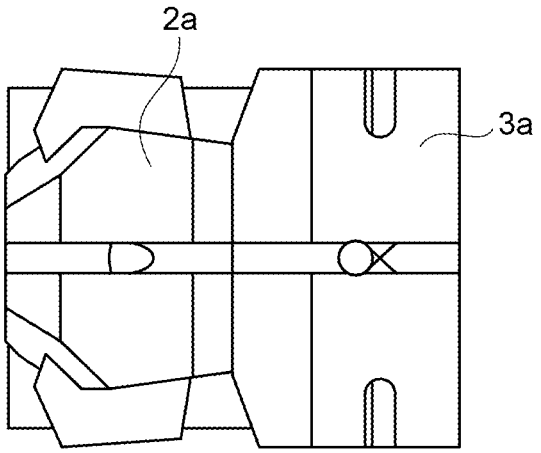
FIG. 19 is a plan view of FIG. 18A.
Figure 20:
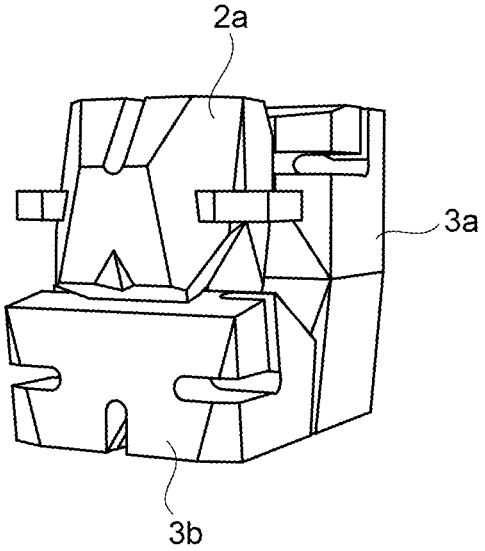
FIG. 20 is a perspective view of FIG. 18A.
Figure 21:
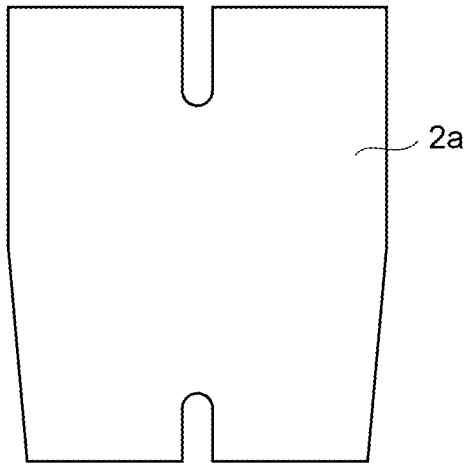
FIG. 21 is a rear view of FIG. 18A.

Thus, folding is possible with positioning so as to have a rectangular outer shape, as shown in FIGS. 19 to 21.

(Variants)

Furthermore, the present invention is not limited to the examples and variants described above, and can be modified without changing the gist.

Figure 22A:
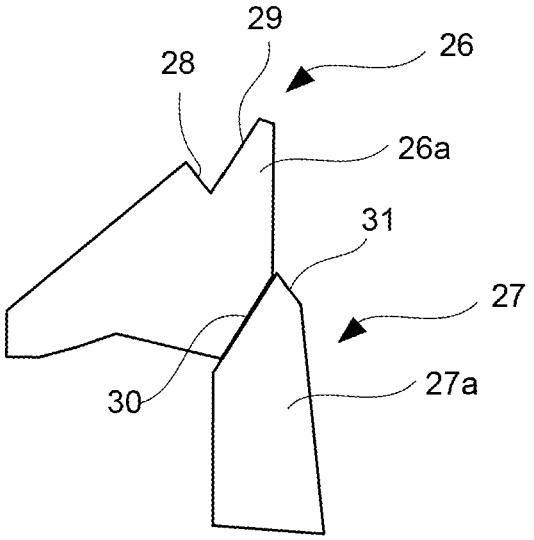
FIGS. 22A and B are schematic views of the same, illustrating variants.
Figure 22B:
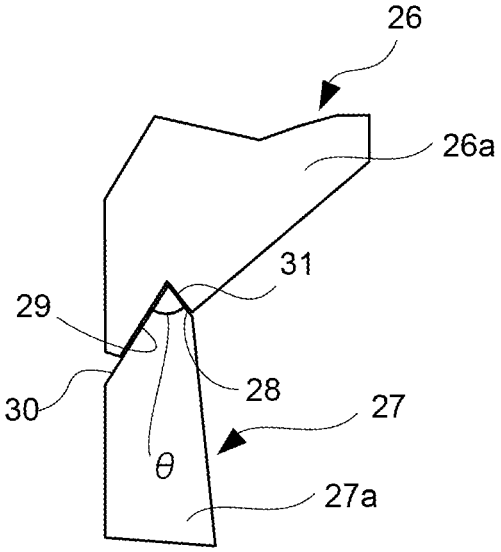

For example, FIGS. 22A and 22B are schematic views showing the head of a giraffe-shaped block-type transformable toy.

In this variant, the two blocks in which the two surfaces are in contact with each other at the same time are the block 26*a* constituting the head portion 26 and the block 27*a* constituting the upper end portion of the neck portion 27, as shown in FIGS. 13A and 13B, and, with this configuration, the displacement of the head portion 26 with respect to the neck portion 27 in the direction of rotational movement is restricted as shown in FIG. 22B. That is to say, in this variant, the lower surfaces 28 and 29 (two surfaces referred to in the claims) of the block 26*a* constituting the head portion 26 are inclined to form an angle θ of 30 degrees (see FIG. 22B), and the upper surfaces 30 and 31 of block 27*a* constituting the neck portion 27 that simultaneously abut the two surfaces of the head portion form an angle of 330 degrees (value resulting from subtracting the angle of 30 degrees formed by the two lower surfaces 28 and 29 of the head portion 22 from 360 degrees).

Note that, if the angle between the two surfaces of the block on the side having the pointed portion is too small, this portion will be weak and there will be no space for the rubber cord to pass through and thus the angles formed by the two surfaces are preferably 30 degrees to 170 degrees and 190 degrees to 330 degrees.

Furthermore, in one example described above, the animal-shaped block-type transformable toy was a monkey, but this may be a giraffe, as in the variant, and other animals may be used, or this may be a humanoid toy.

Further, the present invention is not limited to animal shapes, and may be a block-type transformable toy that represents the form of an artificial object such as a passenger car or an airplane.

EXPLANATION OF THE REFERENCE NUMERALS

1: block-type transformable toy
2: head portion
2*a*: block
3: torso portion
3*a*, 3*b*: block
4: right arm portion
4*a*-4*c*: block
5: left arm portion
5*a*-5*c*: block
6: right leg portion
6*a*-6*c*: block
7: left leg portion
7*a*-7*c*: block
8*a*-8*c*: first to third rubber cord members
10, 11: lower surface of the head portion
12, 13: upper surface of the torso portion
15, 16: front surface of the torso portion
18: slit
19: slit
20: lower surface of the torso portion
21: upper surface of the buttocks portion
22, 23: inclined surface
24: slit
25: slit
26: giraffe head portion
26*a*: block
27: giraffe neck portion
27*a*: block
28, 29: lower surface of the giraffe head portion
30, 31: upper surface of the giraffe neck portion

The invention claimed is:

1. A block-type transformable toy comprising a plurality of adjacent blocks: the adjacent blocks being urged by an elastic cord member in a direction of mutual contact; and so that the block-type transformable toy is transformable between a state of being folded and a state of being extended that the extended shape represents an object, by changing the mutual positional relationships between the adjacent blocks:

at least one pair of the adjacent blocks comprising:

a first block having a first contact surface and a first inclined surface inclining to the first contact surface, the first contact surface and the first inclined surface being next to each other; and a second block having a second contact surface and a second inclined surface inclining to the second contact surface, the second contact surface and the second inclined surface being next to each other; and able to directly contact with the first contact surface and a first inclined surface of the first block simultaneously;

wherein the first block and the second block contact each other urged by the elastic cord where the first contact surface and the first inclined surface contact with the second contact surface and the second inclined surface simultaneously, and rotational movement of the first block and the second block around the elastic cord member is restricted.

2. The block-type transformable toy according to claim 1, wherein the block-type transformable toy is an animal-shaped block-type transformable toy that represents at least a head portion, a torso portion, and a leg portion by way of combining of a plurality of blocks.

3. The animal-shaped block-type transformable toy according to claim 2, wherein the two blocks are blocks constituting a head portion and a torso, and displacement of the head portion in a direction of rotational movement with respect to the torso is restricted by the configuration.

4. The block-type transformable toy according to claim 1, wherein the state of being folded is configured so that the outer shape is a box shape.

5. The block-type transformable toy according to claim 1, wherein an angle between the first contact surface and the first inclined surface is 30 degrees to 170 degrees, and an angle between the second contact surface and the second inclined surface is 190 degrees to 330 degrees.

6. The block-type transformable toy according to claim 1, wherein the two blocks have two or more states in which two surfaces of each are in contact with each other at the same time.

7. The block-type transformable toy according to claim 6, wherein the two or more states are, respectively, the state of being folded and the state of being extended.

* * * * *